US005704147A

United States Patent [19]

Rellinger

[11] Patent Number: 5,704,147

[45] Date of Patent: Jan. 6, 1998

[54] MAGNETIC LETTER BOARDS AND LETTERS

[75] Inventor: Michael Rellinger, Chicago, Ill.

[73] Assignee: Quartet Manufacturing Company, Skokie, Ill.

[21] Appl. No.: 784,456

[22] Filed: Jan. 16, 1997

Related U.S. Application Data

[63] Continuation of Ser. No. 455,261, May 31, 1995, abandoned.

[51] Int. Cl.[6] ..... G09F 7/04

[52] U.S. Cl. ..... 40/621; 40/600

[58] Field of Search ..... 40/600, 621; 403/DIG. 1; 273/239

[56] References Cited

U.S. PATENT DOCUMENTS

| | | | |
|---|---|---|---|
| 1,198,227 | 9/1916 | Hinchey | 403/DIG. 1 X |
| 2,518,204 | 8/1950 | Victor et al. | 40/621 |
| 3,064,330 | 11/1962 | Skidmore | 40/621 X |
| 3,102,314 | 9/1963 | Alderfer | 40/621 X |
| 4,146,976 | 4/1979 | Zambiasi | 40/600 X |
| 4,184,277 | 1/1980 | Larin | 40/621 X |

FOREIGN PATENT DOCUMENTS

| | | | |
|---|---|---|---|
| 154820 | 9/1985 | European Pat. Off. | 40/621 |

*Primary Examiner*—Joanne Silbermann
*Attorney, Agent, or Firm*—Faier & Faier; Martin Faier

[57] ABSTRACT

A magnetic letter board assembly having a magnetic letter board and removably magnetically secured magnetic graphic indicia bodies, wherein the front surface of the board has a pair of inwardly converging walls and a wall bridging the inwardly converging walls, and the graphic indicia bodies have a recess formed with a pair of inwardly converging walls and a bottom wall bridging the inwardly converging walls conforming to the walls and bridging wall of the board, for cooperative removable securement of the indicia bodies on the board. The graphic indicia bodies comprises of magnetic flexible integrally formed graphic indicia and background members formed to fit the board.

20 Claims, 1 Drawing Sheet

MAGNETIC LETTER BOARDS AND LETTERS

CROSS REFERENCE TO RELATED APPLICATION

The present application is a continuation of U.S. patent application Ser. No. 08/455,261, filed May 31, 1995, and now abandoned.

BACKGROUND OF THE INVENTION

This invention relates to magnetic letter boards and magnetic letters and is more particularly directed to such devices which comprise a steel based magnetic attractive letter board and molded magnetic letters which are readily removably mountable and remountable on the board and are used for wall, desk and other signs, directories and similar displays.

SUMMARY OF THE INVENTION

One of the substantial problems with prior art letter boards was that there was no convenient means for simply aligning letters on the board and for changing the display to suit the needs of the user after the letters had been arranged. Where a simple system for mounting was provided, in some cases the contact of letters on the board was insufficient to permit the letters to be loosened and rearranged, or letters were lost or fell from a desired position. On the other hand, where the letter was safely fixed into position, the problem of changing letters was inherent in such an arrangement, which in many cases was difficult, often because the letters had critical flanges which entered grooves on the board, or were locked into a position by holding devices.

Also, prior art letters were generally non-magnetic and constructed with extension pieces or flanges for holding them in slits arranged in the display board. If these extension pieces were broken or bent or the letters otherwise misaligned, the letters became useless. Additionally, such letters frequently stuck in the board groove, making it difficult to pry them out and to rearrange the message on the board and often damaging the letter or board. Such prior art letters were also frequently flimsy, making it easier to damage them. The use of magnetic letters permits construction of letters with greater body and which are more flexible and durable.

Prior art boards were frequently constructed with a velvet-like or flocked surface, so that frequent use caused the board to ball up like felt. The loss of this felt-like surface over time also affected the ability of the board grooves to hold the letters. Cleaning of prior art boards and the letters was also difficult or impossible, and often resulted in puncturing of the letters or other damages to the letter or boards.

Where magnetic letters were used in the prior art, the letters usually had flat backs and usually required use of flat boards, making them difficult to align or hold alignment and easy to move out of alignment. When such boards had stops or other alignment means, they frequently affected the versatility of the letters and the board, sometimes making it impossible to use letters of different size or capital and lower case letters in the same display.

With the present invention, the magnetic board and molded rubber-like magnetic letters have a series of cooperating lands and grooves, which are arranged to provide truncated ridges on the board, i.e. boards with angularly ascending ridges with flat tops, and matching recesses on the back of the magnetic letters, so that these letters fit the ridges in one way only and they cannot be lifted above or dropped below the center line of the groove on the letters or ridge on the board, except as preset by the spacing of the lands and grooves.

Additionally, by providing ridges on the board spaced apart less than the height of the letters, it is possible to use letters or varying sizes and to arrange the letters in a position straddling other letters, thus providing a letter-board arrangement of greater interest and the ability to modify the board display as desired.

The arrangement described not only provides for precise alignment of letters, but also makes it easy to change the lettering without danger of damages to the letters or the board. Rearrangement or adjustment of letter is also easy because the letters are magnetically urged to the board and mechanically biased in the lands and grooves during movement, and the ridge-groove cooperative structure allows letters to be slid into selected position without complete removal of the letters from the board. These steel based boards and molded rubber-like magnetic letters are also easy to clean and thus have extended life over prior art letters and boards.

OBJECTS OF THE INVENTION

It is the object of the present invention to provided magnetic letter boards and magnetic letters of the character referred to.

Another object is to provide magnetic letter boards and letters having cooperative lands on the board and grooves on the back of the letters which permit alignment of the letters on the board.

Another object is to provide such cooperating magnetic letter boards and letters where the lands are formed truncated with angularly converging walls and the grooves conform to receive the lands.

Another object is to provide such magnetic letter boards and letters with cooperating lands and grooves where the lands on the board are spaced apart less than the overall height of the letters.

Another object is to provide such magnetic letter boards and letters with cooperating lands and grooves where the boards are fabricated from steel based sheets and the letters are molded from rubber-like magnetic material.

Another object is to provide such magnetic letter boards and letters with cooperating horizontally arranged parallel lands and grooves for removably securing the letters on the boards.

Another object is to provide such magnetic letter boards and letters which are easy to manufacture and simple and efficient to use and to arrange and change the letters on the boards.

These and other objects and advantages will become apparent as this description proceeds, taken in conjunction with the accompanying drawings.

DESCRIPTION OF A PREFERRED EMBODIMENT

Figure 1:
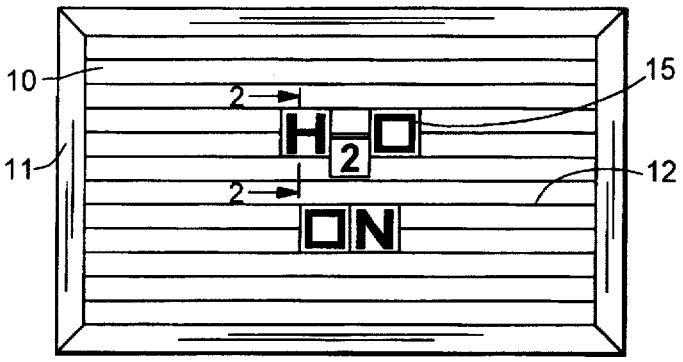
FIG. 1 is a front elevational view of a magnetic letter board and magnetic letters arrange on the board which embody the present invention.
Figure 2:
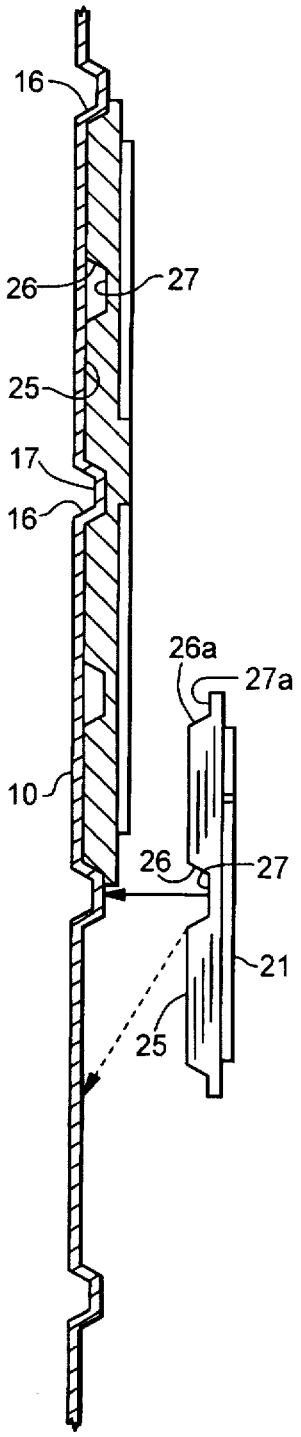
FIG. 2 is a cross-sectional view taken on line 2—2 of FIG. 1, showing with arrows the mounting of an additional letter of varying size on the board.
Figure 3:
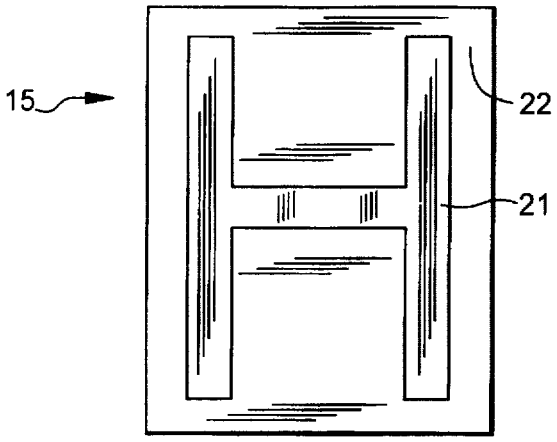
FIG. 3 is an plan view of a magnetic letter embodying the present invention.
Figure 4:
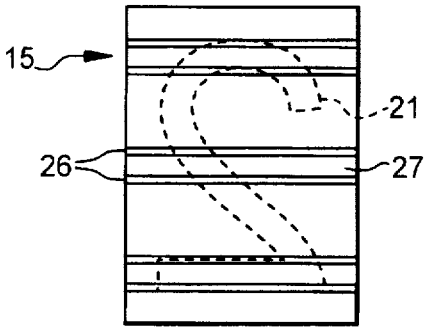
FIG. 4 is a plan view of the back of a magnetic letter-numeral of smaller size showing the face of the letter numeral in phantom lines.

With reference to the accompanying drawings, a magnetic letter board 10 embodying the present invention may have a frame 11 surrounding it, and has spaced apart horizontally arranged parallel ridges 12 and magnetic letters 15 are arranged on and astraddle the ridges 12.

The board 10 is preferably fabricated by embossing from a steel based magnetizable plate and the ridges 12 preferably are formed with outwardly extending converging walls 16 terminating in a truncated top wall 17. The board 10 may be painted or otherwise colored or finished as desired.

Mountable on the board 10 are magnetic letters 15 which have on one surface indicia such as a letter or other graphic display 21, which may comprise an alphabetic letter, number, symbol or the like. These letters 15 are preferably molded from relatively flexible rubber-like plastic material in which ferric-based material is embedded, to make them magnetic. The letters 15 preferably may comprise a graphic display 21 secured on and formed integrally with an enlarged background 22 as shown, with the background colored like the board 10, or the background may be co-extensive with and shaped like the graphic display 21, in which case the graphic display may be of a color or surface different from the board so that it can be seen from a distance.

Figure 5:
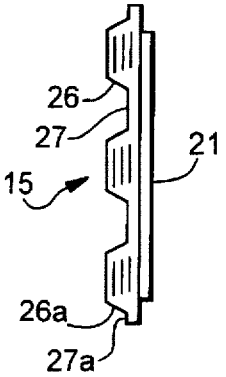
FIG. 5 is a side elevational view of the smaller sized letter shown in FIG. 4.

The rear surface 25 of the letters 15 is formed with inwardly extending walls 26 terminating in a truncated flat bottom wall 27 corresponding to the converging walls 16 and top wall 17 of the board 10. These walls 26 and 27 are spaced apart at least the distance the parallel ridges 12 are spaced from one another on the board. Preferably, there are more than one set of parallel spaced apart walls 26 and 27 on each of the rear surfaces 25, so that letters 15 of varying sizes can be secured on the board 10, or letters can straddle one another, as shown in FIG. 1.

Where small sized letters 15 are used, as shown in FIG. 5, it is not necessary to provide an extra entire set of tapered and flat bottom walls 26 and 27 for every ridge 12, as only one of the ridges must be fully contacted, and another one of the ridges need only be partially contacted by a tapered and flat bottom walls **26*a* and 27*a* to hold the letter 15** in selected position.

Preferably, the letters 15 are relatively flexible and rubber-like, so that they can be manually adjust by finger lifting them and will not become distorted under use. Also, preferably the graphic indicia 21 and the background 22 are integrally molded together so that they will not separate or delaminate.

To install the letters 15 on the board 10, the user selects one or more of the ridges 12 to use and lines up the letters as desired. Vertical alignment and adjustment of the letters 20 is easy to accomplish by merely loosening and sliding the letter along the lands and groove walls, until a selected position is achieved.

The board 10 may be easily cleaned by merely wiping, preferably with a damp cloth, and the letters may be washed or cleaned as desired, without affecting their magnetic attraction to the board.

While a preferred embodiment of the invention has been shown and described in considerable detail, it should be understood that it is not intended that the invention should be limited to the exact construction illustrated as many changes and modifications can be made in these structures without departing from the scope or spirit of the invention.

I claim:

1. A magnetic letter board assembly comprising the combination of a substantially rigid magnetic letter board composed of one material and a plurality of removably magnetically secured magnetic graphic indicia bodies each composed of a material different from and appreciably more flexible than said letter board and arranged on said board to display a message, wherein the front surface of said board and the rear surface of each of said graphic indicia bodies each have a pair of cooperating inwardly converging walls and a surface bridging said walls, each defining lands and grooves and a recess between them extending in the same direction, and each of said graphic indicia bodies has a flexibility permitting the selective lifting of said graphic indicia body from said board and its manipulating along said walls and surface for remounting on said board.

2. In the magnetic letter board assembly recited in claim 1, wherein said letter board is metal made from magnetizable material.

3. In the magnetic board assembly recited in claim 1, wherein each said graphic indicia bodies comprises a formed body of rubber-like material having magnetizable material embedded therein.

4. In the magnetic board assembly recited in claim 3, wherein each said graphic indicia body has one or more graphic indicia arranged on its front surface opposed to said rear surface carrying said walls and bridging wall.

5. In the magnetic board assembly recited in claim 4, wherein said front surface of said graphic indicia body is of lesser cross section than said rear surface and said rear surface defines a background for said front surface.

6. In the magnetic board assembly recited in claim 5, wherein said front surface is of a contrasting finish to said rear background surface.

7. In the magnetic letter board assembly recited in claim 4, wherein said body and graphic indicia are integrally formed.

8. In the magnetic board assembly recited in claim 1, wherein said graphic indicia body has a tapered wall parallel to one of said inwardly converging walls and a wall extending from said tapered wall aligned with said bridge wall.

9. In the magnetic board assembly recited in claim 8, wherein said tapered wall and said wall extending therefrom are arranged on an edge of said graphic indicia body.

10. A magnetic letter board assembly comprising the combination of a substantially rigid letter board composed of one material and a plurality of removably magnetically secured magnetic graphic indicia bodies arranged on said board to display a message, wherein (a) the combined area of said bodies does not exceed the area of said board, (b) at least the front surface of said board or the rear surface of each of said graphic indicia bodies has a magnetic field and the other surface is attracted to said magnetic field, and (c) the front surface of said board and the rear surface of each of said graphic indicia bodies include means for orienting said bodies relative to said board and to each other, said means including, on the front surface of said board and the rear surface of each of said graphic indicia bodies a pair of cooperating inwardly converging walls and a surface bridging said walls, each defining lands and grooves and a recess between them extending in the same direction, and each of said graphic indicia bodies are adapted for selective lifting of said graphic indicia body from said board and manipulated along said walls and surface for remounting on said board.

11. In the assembly recited in claim 10 wherein said pair of cooperating inwardly converging walls and said surface bridging said walls of said front surface of said board comprise a first set of surfaces of said front surface and said first set has a generally horizontal orientation and further including a second set of surfaces of said front surface comprising a pair of cooperating inwardly converging walls and a surface bridging said walls and having a generally horizontal orientation generally parallel to said first set.

12. In the magnetic letter board assembly recited in claim 11, wherein said board has a greater number of pairs of walls than each said graphic indicia body.

13. In the magnetic letter board assembly recited in claim 11, wherein each said graphic indicia body has on at least one of its edges parallel to said recess a wall parallel to one of said recess walls and a flat bottom wall co-planar with said recess wall.

14. In the assembly recited in claim 11 wherein said bodies are composed of a material different than said letter board.

15. In the magnetic letter board assembly recited in claim 14, wherein said graphic indicia body is rubber-like and flexible.

16. In the magnetic letter board assembly recited in claim 14, wherein said letter board is stamped from magnetizable metal material and flat except for said walls.

17. In the magnetic letter board assembly recited in claim 14, wherein a plurality of sets of said walls are provided parallel to one another in a horizontal direction and equal distantly spaced apart on said board to define the horizontal alignment of a plurality of indicia bodies on said board, and a plurality of vertically arranged indicia bodies may be slid along said walls to vertically align said indicia bodies relative to one another.

18. In the assembly recited in claim 11 wherein each of said sets has a sufficient length to permit a plurality of said bodies to be mounted thereon side by side.

19. In the magnetic board assembly recited in claim 18, wherein said graphic indicia body is larger than the space between said plurality of space apart ridges.

20. In the assembly recited in claim 18 wherein said front surface of said board has a sufficient number of sets of said surfaces to accommodate the mounting of at least two of said bodies on said front surface where said bodies of said plurality have a generally vertical orientation relative to each other.

* * * * *